US005988999A

United States Patent [19]

Sato et al.

[11] Patent Number: 5,988,999

[45] Date of Patent: Nov. 23, 1999

[54] SCROLL TYPE FLUID MACHINE HAVING A REDUCED OLDHAM RING GAP

[75] Inventors: Kazuhiro Sato; Hiroyuki Kobayashi, both of Nagoya; Katsumi Hirooka, Nishi-Kasugai-gun, all of Japan

[73] Assignee: Mitsubishi Jukogyo Kabushiki Kaisha, Tokyo, Japan

[21] Appl. No.: 08/975,683

[22] Filed: Nov. 21, 1997

Related U.S. Application Data

[63] Continuation-in-part of application No. 08/646,906, May 9, 1996, abandoned.

[30] Foreign Application Priority Data

May 19, 1995 [JP] Japan ..... 7-121869

[51] Int. Cl.[6] ..... F01C 1/04

[52] U.S. Cl. ..... 418/55.3

[58] Field of Search ..... 418/55.3

[56] References Cited

U.S. PATENT DOCUMENTS

| | | | |
|---|---|---|---|
| 4,655,696 | 4/1987 | Utter | 418/540 |
| 5,403,172 | 4/1995 | Blass et al. | 418/55.3 |

FOREIGN PATENT DOCUMENTS

| | | | |
|---|---|---|---|
| 0 157 390 A2 | 3/1985 | European Pat. Off. . | |
| 58-144601 | 8/1983 | Japan . | |
| 63-170578 | 7/1988 | Japan . | |
| 63-219888 | 9/1988 | Japan | 418/55.3 |
| 1-157201 | 10/1989 | Japan . | |
| 2-185685 | 7/1990 | Japan . | |
| 2-127701 | 10/1990 | Japan . | |

OTHER PUBLICATIONS

JP6010853 Japanese Patent Abstract, publication date Jan. 21, 1994.

*Primary Examiner*—John J. Vrablik

*Attorney, Agent, or Firm*—Wenderoth, Lind & Ponack, L.L.P.

[57] ABSTRACT

A scroll type fluid machine can suppress an increase of inclining vibrations of an Oldham ring with easier adjustments. A stationary scroll (1) and a swivel scroll (2), in a pair, are engaged with each other, and the swivel scroll (2) is driven to make revolutional motions, while being prevented from rotating, via an Oldham ring (18) disposed between an end plate (6) of the swivel scroll (2) and a frame (10). A distance between the end plate (6) of the swivel scroll (2) and the frame (10) is s and a thickness of a ring portion (19) of the Oldham ring (18) is t, A gap δ, formed as (s-t) and a radius r of said ring portion (19) of the Oldham ring (18) is set so that δ/r is 0.01 or less. Thus, by only the ring portion (19) of the Oldham ring (18) being adjusted in its thickness, an increase of inclining vibrations of an Oldham ring (18) can be suppressed.

1 Claim, 3 Drawing Sheets

SCROLL TYPE FLUID MACHINE HAVING A REDUCED OLDHAM RING GAP

This application is a continuation-in-part of now abandoned application, Ser. No. 08/646,906, filed May 9, 1996.

BACKGROUND OF THE INVENTION

1. Field of the Invention

The present invention relates to an improvement in a scroll type fluid machine to be used e.g. as a compressor, an expander, etc.

2. Description of the Prior Art

Scroll type fluid machines, having the ability to operate with a high efficiency and low noise, are used in large numbers as compressors for air conditioning and refrigeration purposes.

Generally, such a scroll type fluid machine e.g. a scroll type compressor, has a compression portion 3, as shown in FIG. 4, in which a stationary scroll 1 and a swivel scroll 2, in a pair, are engaged with each other.

More concretely, the stationary scroll 1 has an end plate 4 and a spiral wrap 5 provided projectingly from the inner face of the end plate 4. The swivel scroll 2 likewise has an end plate 6 and a spiral wrap 7 provided projectingly from the inner face of the end plate 6. These wraps are engaged with each other with a predetermined phase.

The stationary scroll 1 is fixed to a frame 10 provided e.g. within a hermetic casing 9, and the swivel scroll 2, with the back face of its end plate 6 being directed downwardly, is supported on the frame 10 via a thrust bearing 11.

The central portion of the back face of the swivel scroll 2 is connected to a drive source, such as a rotational shaft 13 of an electric motor 12, provided within the hermetic casing 9 so that the swivel scroll in its entirety is driven to make revolutional swivel motions around the central axis of the stationary scroll 1. More concretely, at the shaft end of the rotational shaft 13, there is provided an eccentric pin 14 to be fitted rotatably in the central portion of the end plate of the swivel scroll 2, and by the rotation of the electric motor 12, the swivel scroll 2 is driven to make revolutional swivel motions relative to the stationary scroll 1.

The scroll type compressor compresses work by the swivel scroll being driven by the electric motor 12 to make swivel motions. That is, a plurality of compression chambers. 15 are formed between the wraps and move to gradually reduce their volumes while moving from a suction port 16 disposed on the outer side of the wrap 5 to a discharge port 17 disposed at the center of the wrap 5.

In such a scroll type fluid machine, in order to operate, there is provided an Oldham ring 18 between the end plate 6 of the swivel scroll 2 and the frame 10, as shown in FIG. 5, for prohibiting rotation of the swivel scroll 2.

The Oldham ring 18 is conventionally constructed so that it has a ring portion 19, as shown in FIG. 6, located between the end plate 6 of the swivel scroll 2 and the frame 10. At two places where a diametrical line of the ring crosses the ring portion 19, two swivel side keys 20, 20 are formed, in a pair, projecting from the end faces of the ring portion 19 as an integral body with the ring portion 19. At two places of the ring portion 19 on a diametrical line perpendicularly crossing the diametrical line, two stationary side keys 21, 21 are formed, in a pair, projecting from the opposite end faces of the ring portion 19 as an integral body with the ring portion 19.

The swivel side keys 20, 20 are fitted slidably in key ways 22 formed extendingly in the diametrical direction on the back face (lower face) of the end plate 6 of the swivel scroll 2 and the stationary side keys 21, 21 are likewise fitted slidably perpendicular to key ways 23 formed extending in the diametrical direction on the upper face of the frame 10.

Thus, upon rotation of the rotational shaft 13, the swivel side keys 20, 20 reciprocally displace in the direction of arrows A (FIG. 6) within the key ways 22. The stationary side keys 21, 21 reciprocally displace in the direction of B (FIG. 6) within the key ways 23, thus the swivel scroll 2 makes revolutional swivel motions, without making rotational motions, around the central axis of the, stationary scroll 1.

In the Oldham ring 18, as the position of the key is deviated from the ring portion 19 in the thickness direction, if the scroll type fluid machine makes a high speed rotation, the Oldham ring 18 tends to incline by a moment caused by an inertia force Fi (FIG. 7) of the Oldham ring 18 and a reaction force Fd (FIG. 7) acting against said inertia force on the end face of the key way 22 of the swivel side.

The Oldham ring 18 thus reciprocates while it is inclining and making vibrations (hereinafter such vibrations are referred to as "inclining vibrations). But during high speed rotation, as the inertia force Fi of the Oldham ring 18 increases in proportion to the square of the rotation, the moment sharply increases and the Oldham ring 18 increases in inclining vibrations.

As a result, the Oldham ring 18 collides with the end plate 6 of the swivel scroll 2 and with the frame 10, which causes shock sounds. Thus there is a problem that the operation noise of the scroll type fluid machine is increased more and more.

Especially if the flatness of the Oldham ring 18 is not good enough, due to the revolutional swivel motions, being accompanied by conical motions, of the swivel scroll 2 in the compression process: vibrations of the Oldham ring 18 are remarkably increased and intensified; the Oldham ring 18 wears abnormally, seizure occurs between the Oldham ring 18 and the end plate 6 (the swivel scroll 2) or between the Oldham ring 18 and the frame 10; and there is the fear of a fluid machine not operating.

one countermeasure therefor in recent years is disclosed in Japanese laid-open utility model application No. Hei 1(1989) 157201. That is, an allowable inclination of the Oldham ring 18 is restricted by the thickness of the swivel side key 20 and the depth of the key way 22 in which the swivel side key 20 is fitted, another is disclosed in Japanese laid-open utility model application No. Hei 2(1990)-127701. That is, an allowable inclination of the Oldham ring 18 is restricted by the bottom face of the key way 23 in which the stationary side key 21 is fitted and the sliding face of the thrust bearing 11 with which the stationary side key 21 makes sliding contact.

In the above prior art, in order to adjust the thickness of the individual separate key portions, or to control the flatness between the separate key portions, only the individual portion of the key portions or area between the key portions is restricted, There is thus a difficulty in making the thickness adjustment and the flatness control on the whole.

Therefore, a simpler countermeasure is desired.

SUMMARY OF THE INVENTION

In view of the circumstances as mentioned above, it is an object of the present invention to provide a scroll type fluid machine in which increase of inclining vibrations can be suppressed by a simpler adjustment.

In order to attain this object, according to the present invention the distance between an end plate of a swivel scroll and a frame s, and the thickness of a ring portion of a Oldham ring t, a gap δ, formed as (s-t), and the radius r of the ring portion of the Oldham ring is set so that δ/r is 0.01 or less.

Thus the present inventors having focused on the ratio of δ to r (δ/r) in order to control the vibration and noise of a scroll machine. As a result of experiments, it has been found that there is a critical point of noise increase in the vicinity when δ/r is 0.01. If the value of the gap δ is maintained to about 0.1 mm or less as the scroll machine, and thus the Oldham ring, becomes larger, the scroll machine will require very high accuracy, resulting in a high cost of machining of the ring surface as well as the bearing surface. In addition, if foreign matter is bitten into in the relatively small gap, it can cause deformation of the ring, or increase the risk of seizure or burning of the ring surface and the bearing surface. Furthermore, if the value δ is smaller, the operating costs of the scroll machine becomes high.

Thus, the present invention recognizes the importance of the ratio of δ/r for the purpose of controlling the vibration and noise of the scroll machine. If the radius of the ring portion of the Oldham ring becomes larger, the gap δ= s-t can also become larger in accordance with the present invention, as long as the ratio of δ/r being 0.01 or less is maintained. In addition to the above, in order to suppress an increase of the inclining vibrations caused by reason of the A flatness warp of the ring portion of the Oldham ring located between the end plate of the swivel scroll and the frame is made 0.25 mm or less.

By setting δ/r to be 0.01 or less, experiments indicate that the colliding speed becomes smaller. Even if the Oldham ring inclines and collides with the swivel scroll or the frame, it is found that the shock force becomes less. This means that an increase of the inclining vibrations of the Oldham ring is suppressed, and an increase of noise due to shocks is prevented.

This effect is obtained just by the ring portion in the Oldham ring being adjusted of its thickness. As compared with adjustment of thickness of individual key portions or controlling the flatness between individual key potions, the suppression of the inclining vibrations of the Oldham ring is made easier.

By having the warp of the ring portion of the Oldham ring located between the end plate of the swivel scroll and the frame 0.25 mm or less, an increase of the inclining vibrations of the Oldham ring caused for reason of flatness of the Oldham ring is also suppressed.

BRIEF DESCRIPTION OF THE DRAWINGS

FIG. 2(*b*) is a diagrammatic view showing a state where the increse of inclining vibrations of the Oldham ring is suppressed by the gap being restricted.

DESCRIPTION OF THE PREFERRED EMBODIMENTS

Figure 1:
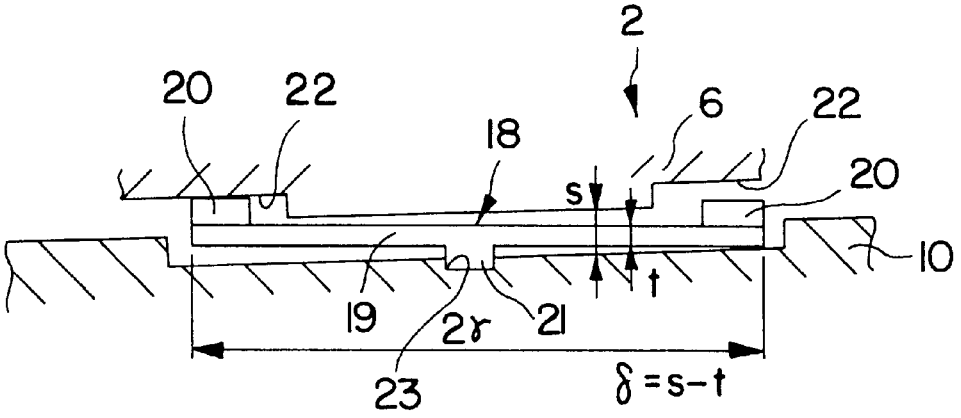
FIG. 1 is a cross sectional view showing an Oldham ring and surrounding components of a scroll type compressor of a first preferred embodiment according to the present invention.
Figure 2A:
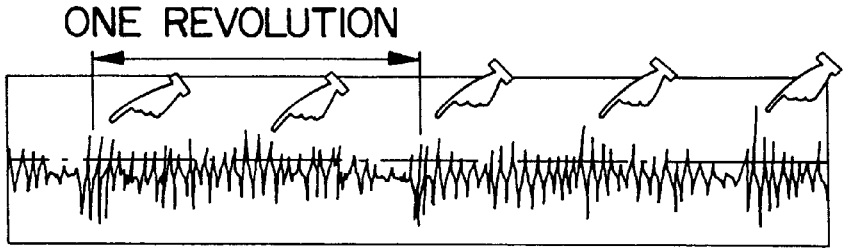
FIG. 2(*a*) is a diagrammatic view showing a state where the inclining vibrations of the Oldham ring are increasingly occurring.
Figure 2B:
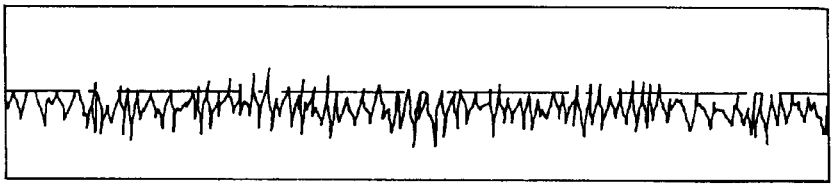

Herebelow, the present invention is described based on a first preferred embodiment shown in FIGS. 1 and 2.

Figure 4:
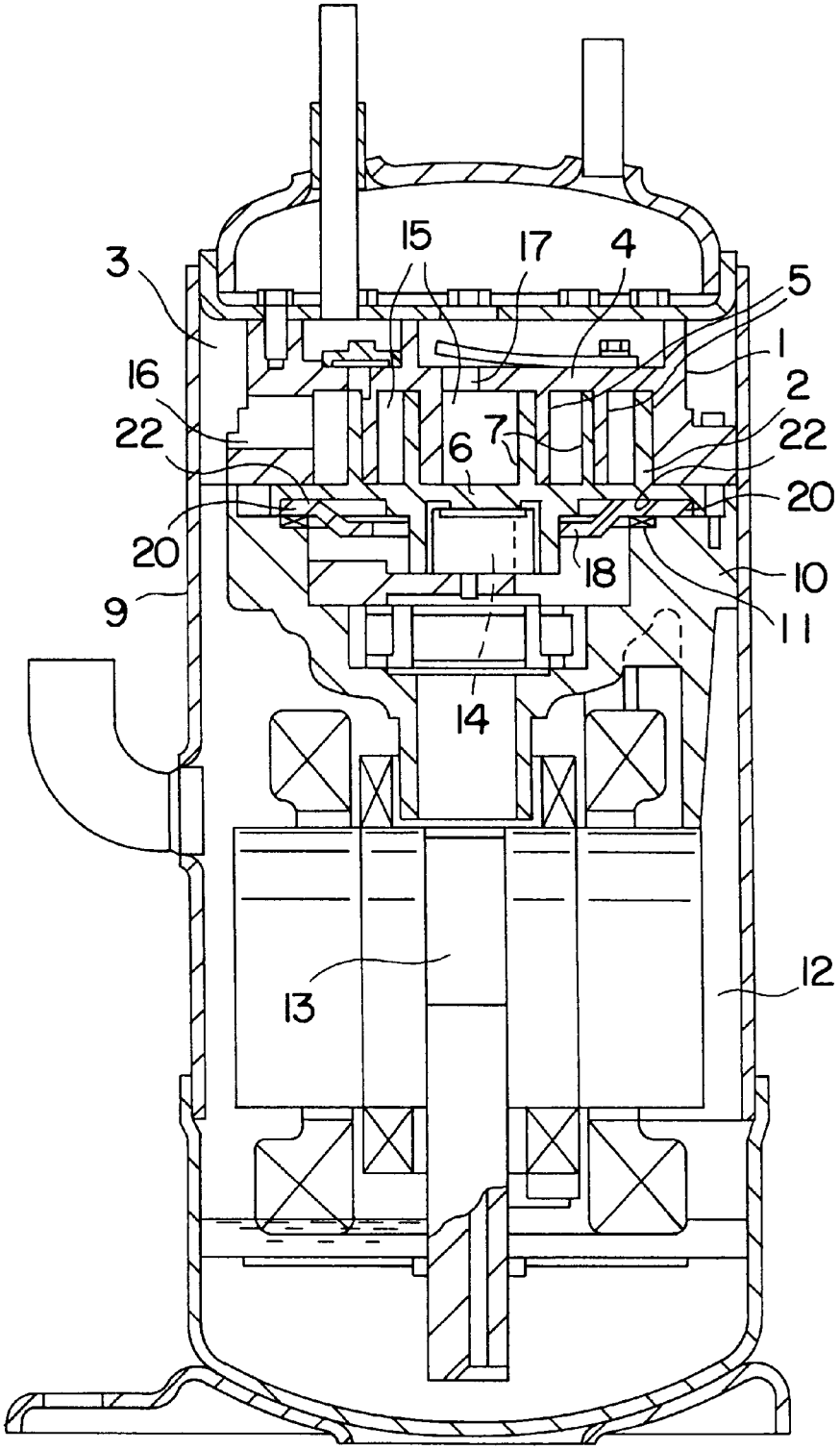
FIG. 4 PRIOR ART
FIG. 4 is a cross sectional view showing a structure of a scroll type compressor.
Figure 5:
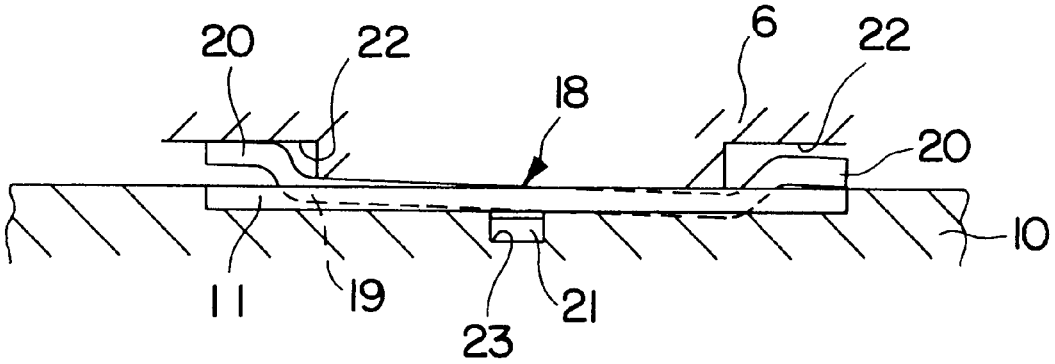
FIG. 5 is a side view showing an Oldham ring and its surrounding components.
Figure 6:
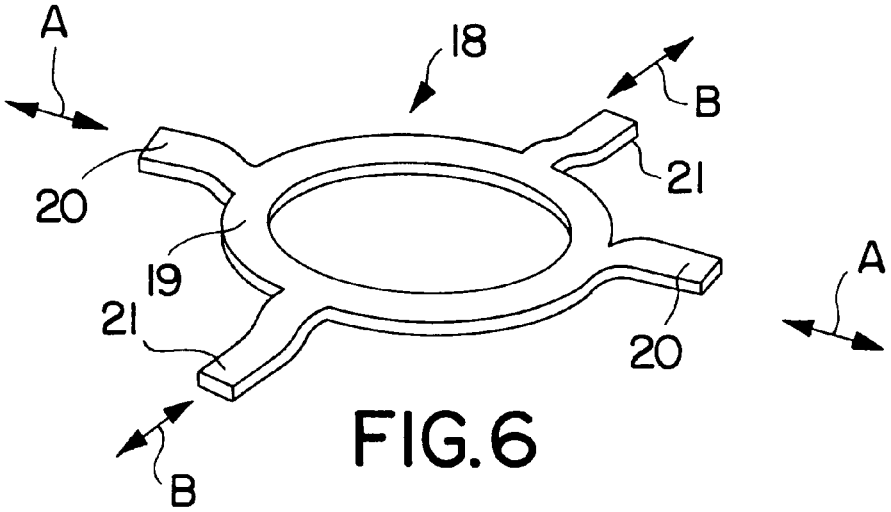
FIG. 6 is an explanatory perspective view showing a structure of the Oldham ring of FIG. 5.
Figure 7:
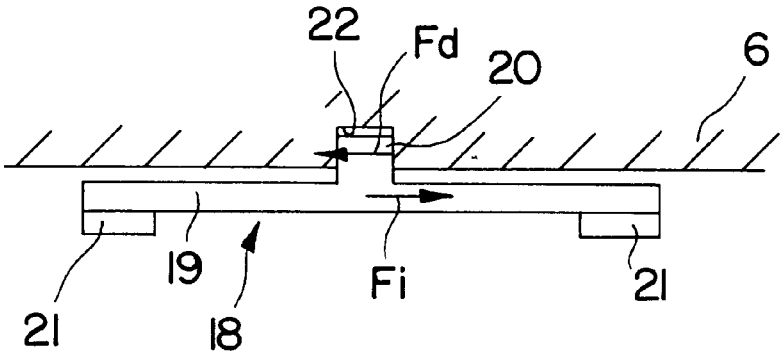
FIG. 7 is an explanatory view showing how the inclining vibrations of the Oldham ring are generated.

As the entire structure of a scroll type fluid machine is the same as that of FIG. 4 described above, FIG. 4 will be commonly used as the entire view of a scroll type fluid machine, and a complete description of a scroll type fluid machine is omitted here. The main part of the invention only will be described here.

That is, FIG. 1 shows an Oldham ring 18 disposed between a swivel scroll 2 and a frame 10. Incidentally, the frame 10 supports a rotational shaft 13 to drive the swivel scroll 2 to make revolutional swivel motions.

The Oldham ring 18, being the same as that described before, is constructed so that it has a ring portion 19 to be located between an end plate 6 of the swivel scroll 2 and the frame 10. At two places where a diametrical line of the ring crosses the ring portion 19, two swivel side keys 20, 20 are formed, in a pair, projecting from the end faces of the ring portion 19 as an integral body with the ring portion 19. at two places of the ring portion 19 on a diametrical line perpendicularly crossing the above-mentioned diametrical line, two stationary side keys 21, 21 are formed, in a pair, projecting from the opposite end faces of the ring portion 19 as an integral body with the ring portion 19.

The swivel side keys 20 of the Oldham ring 18 are fitted slidably in key ways 22 formed on the lower face of the end plate 6 of the swivel scroll 2. The stationary side keys 21 are fitted slidably in key ways 23 formed on the upper face of the frame 10. The swivel scroll 2 makes revolutional swivel motions, without making rotational motions, around the central axis of a stationary scroll 1.

In the Oldham ring 18, the ratio of the amount of gap between the swivel scroll 2 and the frame 10 to the radius r of the ring portion 19 is limited within a predetermined value.

That is, where the distance between the end plate 6 of the swivel scroll 2 and the frame 10 is s and the thickness of the ring portion 19 of the Oldham ring 18 is t, the ratio of the gap δ, formed as (s-t), to the radius r of the ring portion 19 of said Oldham ring 18 is set so that δ/r is 0.01 or less.

During high speed rotation of a scroll type fluid machine with such a setting, even if the Oldham ring 18 inclines and collides with the end plate 6 of the swivel scroll 2 or with the frame 10, it is found that the colliding speed becomes smaller and the shock force caused thereby also becomes smaller.

That is, there have taken place experiments for studying the increase of the shock sounds wherein a scroll type fluid machine is operated at a high speed rotation with The gap δ (the gap formed as the difference of the distance s between the end plate 6 of the swivel scroll 2 and the frame 10 and the thickness t of the ring portion 19 of the Oldham ring 18) being variously changed relative to the radius r of the ring portion 19 of the Oldham ring 18, and a the resulting difference as shown in FIG. 2 is obtained.

FIG. 2 shows a difference of the vibrations of the frame portion between a state where shocks occur and a state where shocks do not occur. FIG. 2(*a*) shows a state where the shocks occur and FIG. 2(*b*) shows a state where the shocks do not occur.

From the above experiments, it is confirmed that remarkable increases of the shock sounds occur at the places pointed to by the fingers of FIG. 2(*a*) at the time when the value of $\delta/r$ is more than 0.01, and do not occur at the time when the value of $\delta/r$ is 0.01 or less as seen in FIG. 2(*b*).

The reason for that is considered because, at the time of $\delta/r$ being 0.01 or less, the collision speed of the Oldham ring 18 is small, and even if the Oldham ring 18 inclines and collides with the swivel scroll 2 or the frame 10, only small shock forces occur.

That is, an increase of the inclining vibrations of the Oldham ring can be suppressed. As a result, shocks can be avoided and an increase of noise due to the shocks can be prevented.

And yet, this effect is obtained only by the ring portion 19 in the Oldham ring 18 being adjusted of its thickness t. As compared with adjusting the thickness of individual key portions or controlling the flatness between individual key portions in the prior art, suppression of the inclining vibrations of the Oldham ring is made easier.

As discussed in the Summary of the Invention, if the gap $\delta$ is 0.1 mm or less as the scroll machine overall becomes large, high accuracy and high costs of machining of the ring surface and bearing surface are required. Foreign matter getting into the gap can cause deformation, seizure or burning. Furthermore, a small value of $\delta$ increases the operating costs of the scroll machine.

With scroll compressors of 3 to 10 PS class, the value of r will be 30 to 50 mm. Accordingly, if $\delta/r$ is 0.01 or less, then $\delta$ will be 0.3 to 0.5 mm or less. Thus, for this type of machine, there is no need to reduce the gap $\delta$ to a size as small as 0.1 mm, in accordance with the present invention. When r is 35 mm or more and $\delta/r$ should be 0.01 or less and 0.003 or more. This results in the gap $\delta$ being greater than or equal to 0.105 mm, or greater than 0.1 mm. Thus, $0.003 \leqq \delta/r \leqq 0.01$ and $r \geqq 35$ mm, in accordance with the present invention.

Figure 3:
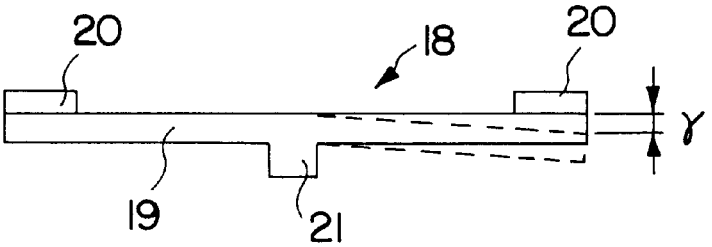
FIG. 3 is a side view showing an Oldham ring of a scroll type compressor of a second preferred embodiment according to the present invention.

FIG. 3 shows a second preferred embodiment according to the present invention.

In the second preferred embodiment, in addition to the provision of $\delta/r$ as mentioned in the first preferred embodiment, the warp $\gamma$ of the ring portion 19 of the Oldham ring 18 located between the end plate 6 of the swivel scroll 2 and the frame 10 is restricted.

More concretely, this warp $\gamma$ of the ring portion 19 is set to 0.25 mm or less this warp $\gamma$ being defined by the amount which said ring portion deviates from a theoretical planar form at the outer periphery thereof this can be seen from FIG. 3.

By such a setting of the warp of the ring portion 19, an increase in the inclining vibrations of the Oldham ring 18 caused by reason of the flatness of the Oldham ring 18 can also be suppressed.

That is, in the scroll type fluid machine, if the flatness of the ring portion 19 of the Oldham ring is not good enough, due to the revolutional swivel motions, being accompanied by conical motions, of the swivel scroll 2 in the compression process, the inclining vibrations of the Oldham ring 18 are increased.

Experiments have taken place wherein a scroll type fluid machine is operated with the warp $\gamma$ of the ring portion 19 being variously changed. As a result, it is confirmed that an increase of the inclining vibrations of the Oldham ring 18 occurs when the warp $\gamma$ of the ring portion 19 of the Oldham ring 18 is more than 0.25 mm and does not occur at the time when the warp $\gamma$ is 0.25 mm or less.

That is, by the warp of the ring portion 19 being restricted, the inclining vibrations of the Oldham ring 18 can be further avoided and an increase of noise can be further prevented.

Incidentally, the present invention is applied to a scroll type compressor in the above, but needless to mention it is, not limited thereto, it can be applied also to other scroll type fluid machines, such as like a scroll type expander etc.

As mentioned above, by the gap formed by the difference of the distance between the end plate of the swivel scroll and the frame and the thickness of the ring portion of the Oldham ring between the end plate of the swivel scroll and the frame being restricted, an increase of the inclining vibrations of the Oldham ring is suppressed, shocks due to the Oldham ring are avoided and an increase of noise due to the shocks can be prevented.

And yet, this effect is obtained only by the ring portion in the Oldham ring being adjusted of its thickness. As compared with adjusting the thickness of individual key portions, or controlling the flatness between individual key portions, suppression of the inclining vibrations of the Oldham ring is facilitated.

In the above effect of the invention, an increase of the inclining vibrations of the Oldham ring caused by reason of flatness of the Oldham ring can also be suppressed, and further shock avoidance and noise prevention can be obtained.

While the preferred form of the present invention has been described, variations thereto will occur to those skilled in the art within the scope of the present inventive concepts, which are delineated by the following claims.

What is claimed is:

1. A scroll type fluid machine comprising:

a stationary scroll and a swivel scroll engaged with each other, said swivel scroll having an end plate;

a frame, said stationary scroll being stationary relative to said frame, and said end plate of said swivel scroll and said frame being spaced a distance s from each other; and an Oldham ring disposed between said end plate of said swivel scroll and said frame, said Oldham ring comprising a ring portion and key portions on said ring portion engaging said frame and said end plate of said swivel scroll, said ring portion having a thickness t and a radius r;

wherein s is greater than t, wherein a gap $\delta$ is defined by s-t, wherein $\delta/r$ is 0.01 or less and 0.003 or more, and wherein r is 35 mm or more.

* * * * *